US008920629B2

(12) United States Patent
Masuko et al.

(10) Patent No.: US 8,920,629 B2
(45) Date of Patent: Dec. 30, 2014

(54) DIESEL OIL COMPOSITION

(75) Inventors: Masachika Masuko, Kanagawa (JP); Nobuhiro Okabe, Tokyo (JP)

(73) Assignee: Shell Oil Company, Houston, TX (US)

( * ) Notice: Subject to any disclaimer, the term of this patent is extended or adjusted under 35 U.S.C. 154(b) by 114 days.

(21) Appl. No.: 13/333,443

(22) Filed: Dec. 21, 2011

(65) Prior Publication Data

US 2012/0325172 A1 Dec. 27, 2012

(30) Foreign Application Priority Data

Dec. 24, 2010 (JP) ..... 2010-288915

(51) Int. Cl.
*C10L 1/08* (2006.01)
*C10L 1/16* (2006.01)

(52) U.S. Cl.
CPC ..... *C10L 1/1608* (2013.01)
USPC ..... 208/15; 585/14; 585/27; 44/300

(58) Field of Classification Search
USPC ..... 208/15; 585/14; 44/300
See application file for complete search history.

(56) References Cited

U.S. PATENT DOCUMENTS

| | | | | | |
|---|---|---|---|---|---|
| 4,699,629 | A * | 10/1987 | Croudace et al. | 44/429 |
| 4,723,963 | A * | 2/1988 | Taylor | 44/436 |
| 4,773,916 | A * | 9/1988 | Croudace et al. | 44/440 |
| 5,322,528 | A * | 6/1994 | Lu-Dai Sung et al. | 44/336 |
| 5,454,933 | A * | 10/1995 | Savage et al. | 208/212 |
| 6,086,645 | A * | 7/2000 | Quigley et al. | 44/418 |
| 6,808,542 | B2 * | 10/2004 | Nguyen et al. | 44/300 |
| 7,820,031 | B2 * | 10/2010 | D'Alessandro et al. | 208/7 |
| 8,361,309 | B2 * | 1/2013 | Lopez et al. | 208/15 |
| 2004/0129608 | A1 * | 7/2004 | Clark et al. | 208/307 |
| 2007/0151901 | A1 * | 7/2007 | Sain et al. | 208/208 R |
| 2008/0072476 | A1 * | 3/2008 | Kennel et al. | 44/311 |
| 2010/0155302 | A1 * | 6/2010 | Kaminsky et al. | 208/212 |

FOREIGN PATENT DOCUMENTS

| | | | |
|---|---|---|---|
| JP | 2000109860 | 4/2000 | B01J 23/88 |
| JP | 2006137919 | 6/2006 | C10L 1/08 |
| JP | 2006137920 | 6/2006 | C10L 1/08 |
| JP | 2006137921 | 6/2006 | C10L 1/08 |
| JP | 2006137922 | 6/2006 | C10L 1/08 |
| JP | 2008144156 | 6/2008 | C10L 1/08 |
| JP | 2008144158 | 6/2008 | C10L 1/08 |
| JP | 2008266420 | 11/2008 | C10G 45/08 |

* cited by examiner

*Primary Examiner* — Ellen McAvoy

(57) ABSTRACT

A diesel oil composition is provided which, while having a low sulfur content, has an excellent oxidative stability even under the higher temperature conditions that can be expected for the operating environments of the future. The diesel oil composition has a fluorenes content of at least 200 ppm by mass and an acenaphthylenes content of at most 2000 ppm by mass.

20 Claims, No Drawings

DIESEL OIL COMPOSITION

The present application claims the benefit of Japanese Patent Application No. 2010-288915, filed Dec. 24, 2010, the entire disclosure of which is hereby incorporated by reference.

FIELD OF THE INVENTION

This invention relates to the oxidative stability of so-called sulfur-free diesel oil compositions having a sulfur content of not more than 10 ppm by mass.

BACKGROUND OF THE INVENTION

From the standpoint of preventing damage to the environment by sulfur oxides and from the standpoint of the increasing rigour of exhaust gas regulations for cars, demand has grown in society for a reduction in the sulfur content of car fuels. Present regulations relating to sulfur content have become increasingly rigorous in stages, and the sulfur content of the diesel oils currently on the market is limited by a JIS standard to not more than 10 ppm by mass.

In general, to reach a sulfur content of not more than 10 ppm by mass it is possible to reduce the petroleum fractions having distillation characteristics corresponding to the composition, that is to the diesel oil, by, for example, using methods of hydrodesulfurisation such as disclosed in Japanese Laid-open Patents 2000-109860 and 2008-266420, and at the same time the colour is improved by the addition of heavy fractions such as polycyclic aromatics contained in the raw material, and an almost colourless and transparent diesel oil is obtained for the market. The colour itself has no impact on the performance of diesel engines used in cars, but given that deterioration of the colour gives an impression that there has been deterioration of the diesel oil's characteristics, it makes sense for the technology to improve the colour as well, e.g. mainly by the methods of hydrodesulfurisation as mentioned above.

It is known that in diesel oils, peroxides are formed by oxidation and cause deterioration of elements of the vehicle fuel system (rubber and metal elements). They also give rise to problems such as clogging of fuel filters through the formation of sludge, and poor sliding of injection pumps. In consequence, whilst the property of oxidative stability of diesel oil in the present JIS standard has not been standardised, the oxidative stability of diesel oil is an important indicator, and demand calls for diesel oils with excellent oxidative stability. Furthermore, in diesel engines of recent years, common rail-type fuel injection devices have been adopted as a way of reducing particulates (or particulate matter: referred to as "PM" hereinafter), but in such common rail-type fuel injection devices, at the structural level, surplus fuel fed in under pressure to the injectors but not sprayed into the combustion chambers is returned to the fuel tank via a return circuit. This fuel returned to the fuel tank (return fuel) is at an elevated temperature, and so oxidation of the diesel oil inside the fuel tank is promoted, which means that there is even more of a requirement to enhance the oxidative stability of the diesel oil. Also, because of the increasing rigour of exhaust gas standards in recent years, it can be expected that fuel injection pumps will work at ever higher pressures, and the temperature of the return fuel will rise, too, which means that the importance of oxidative stability will further increase.

However, in recent years, it has become clear that, in diesels oil in which the sulfur component has been reduced to not more than 10 ppm by mass, the oxidative stability also ends up being reduced. Countermeasures against the reduction of oxidative stability, for example by using anti-oxidants, have generally been common, but heavy use of additives leads to increased costs, and other problems may also arise because of separation of additives under certain conditions. Methods have therefore been proposed to enhance the oxidative stability of the reduced-sulfur composition itself without using additives. For example, Japanese Laid-open Patents 2006-137919, 2006-137920, 2006-137921 and 2006-137922 purport to have discovered that naphthene benzenes and fluorenes have a detrimental effect on oxidative stability, and that naphthalenes effect an improvement in oxidative stability, and also therefore propose techniques for making a low-sulfur diesel oil composition which has excellent oxidative stability without adding any anti-oxidant, by regulating the sum of the naphthene benzenes and fluorenes to not more than 8.0% by volume and the naphthalenes to 0.5 to 3.0% by volume, thereby regulating the range of the oxidation stability index.

Also, in Japanese Laid-open Patents 2008-144156 and 2008-144158, techniques have been disclosed for making a low-sulfur diesel oil composition which has excellent oxidative stability without adding any anti-oxidant, by regulating the total contents of styrenes and dienes of specific carbon numbers, being substances that have a detrimental effect on oxidative stability, and of condensed bicyclic and tricyclic aromatic hydrocarbons, being substances to improve oxidative stability, and thereby bringing the oxidation index to within a suitable range.

However, in the technology as disclosed in the above-mentioned patent literature, although it has been shown that substances such as naphthene benzenes, fluorenes, styrenes, dienes, condensed bicyclic and tricyclic aromatic hydrocarbons have some effect on the oxidative stability of diesel oil compositions, there are many unclear points as regards the effect they each have on oxidative stability. Also, in the prior art, oxidative stability has been evaluated at 100° C. or 115° C., but since the fuel temperatures in the newest fuel injection pumps are even higher, the present situation is that it is uncertain to what extent these substances contribute to oxidative stability at high temperatures.

SUMMARY OF THE INVENTION

In one embodiment, a diesel oil composition is provided having sulphur content of at most 10 ppm by mass, the fluorenes content of at least 200 ppm by mass and the acenaphthylenes content of at most 2000 ppm by mass.

DETAILED DESCRIPTION OF THE INVENTION

There have been no techniques disclosed as regards substances that have an effect on colour of the diesel oil, and there have also been no techniques disclosed which clarify the relationship between colour and oxidative stability.

The aim of this invention therefore is to offer a diesel oil composition which, while having a low sulfur component, will have excellent oxidative stability even under the higher temperature conditions that can be expected for the operating environments of the future.

In the diesel oil composition of this invention, the sulfur content is not more than 10 ppm by mass, the fluorenes content is not less than 200 ppm by mass, and the acenaphthylenes content is not more than 2000 ppm by mass.

In this invention, the sulfur content is the sulfur content as determined by JIS K 2541-2 "Crude oil and petroleum products—Determination of sulfur content. Part 2: Oxidative microcoulometry". The amounts of fluorenes and acenaphthylenes contained are the amounts as determined by a gas chromatograph-mass spectrometer (GC-MS), which couples a gas chromatograph (GC) with a mass spectrometer (MS).

The amount of the sulfur component is not more than 10 ppm by mass. If the value is below this, not only are the amounts of the sulfur oxides and sulphate emissions kept low in the PM in the exhaust gases of a diesel car, without having any detrimental effect on performance of the exhaust gas after-treatment apparatus, but this is also connected with a reduction in other harmful substances such as nitrogen oxides. The value should be not more than 10 ppm by mass, but if desulfurisation is carried out excessively, not only will the oxidative stability which is attributable to the sulfur content decrease, but also the fluorenes may decrease and the amount of acenaphthylenes increase, because of subsidiary reactions such as a hydrogenation reaction of aromatics which occur at the same time as the desulfurisation reaction, so that the value is preferably in the range of from 1 to 10 ppm by mass but more preferably in the range of from 3 to 10 ppm by mass.

In this invention, "fluorenes" denote fluorene as well as alkyl-substituted fluorenes, and not less than 200 ppm are necessary. If the value is not less than 200 ppm by mass in a diesel oil with a sulfur content of not more than 10 ppm by mass, it is possible to maintain the oxidative stability of the diesel oil at high temperatures, but not less than 500 ppm by mass is preferable, and not less than 1500 ppm by mass is more preferable. However, because the amount of PM in the exhaust gas will increase if the content is too large, not more than 12000 ppm by mass is preferable, not more than 5000 ppm by mass is more preferable, and not more than 2000 ppm is yet more preferable.

Also in this invention, "acenaphthylenes" denote acenaphthylene as well as alkyl-substituted acenaphthylenes. If the amount of acenaphthylenes increases, the oxidative stability deteriorates, and there is the possibility of the occurrence of problems attributable to oxidative stability in the fuel supply systems of cars, so that not more than 2000 ppm by mass is preferable, not more than 1800 ppm by mass is more preferable, and not more than 450 ppm by mass is yet more preferable. However, reducing the amount of acenaphthylenes alone is difficult, and in desulfurisation treatments, under conditions of reducing the acenaphthylenes, many more fluorenes are reduced than acenaphthylenes, so that, to maintain the amount of fluorenes at the desirable level, making the amount of acenaphthylenes not less than 25 ppm by mass is preferable, and making them not less than 400 ppm by mass is more preferable.

An 'alkyl' moiety wherever used herein is suitably a C1 to C10 alkyl moiety in a first embodiment, more suitably a C1 to C6 alkyl moiety. In a second embodiment, an 'alkyl' moiety wherever used herein is suitably a C1 to C4 alkyl moiety, more suitably a C1 or C2 alkyl moiety.

The desired oxidation stability is obtained by keeping the amount of fluorenes and the amount of acenaphthylenes within specified ranges. Provided that there is a desulfurisation treatment where the sulfur content can be made not more than 10 ppm by mass, there is no restriction of any sort as regards the colour, but by keeping the fluorenes and acenaphthylenes within the specified ranges, the Saybolt colour is generally not more than +25. Also, in order to obtain a higher oxidative stability, it is necessary that it be preferably not more than +10 and more preferably not more than −16. On the other hand, if the Saybolt colour is more than +25, not only will manufacturing costs increase through raising the hydrogen partial pressure in the hydrodesulfurisation treatment or through the fact that the hydrogen-oil ratio increases, but also there is a possibility that, while the acenaphthylenes which cause deterioration of oxidative stability are reduced, the fluorenes which improve oxidative stability at the same time are reduced to below 200 ppm by mass, which means that in effect the oxidative stability can be expected to deteriorate.

A high oxidative stability is preferred, but if the induction period according to a PetroOXY test with a test temperature of 140° C. is at least not less than 65 minutes, but preferably not less than 70 minutes and more preferably not less than 75 minutes, this will satisfy the oxidative stability required for use in common-rail fuel injection devices.

The PetroOXY test is run on the PetroOXY apparatus available from Petrotest Instruments GmbH & Co., Germany. Standard test method ASTM D 7545-09 (Standard test method for oxidation stability of middle distillate fuels—rapid small scale oxidation test, RSSOT) is approved for this equipment.

We have found that acenaphthylenes cause a deterioration in oxidative stability and also that fluorenes, which in the prior art have been regarded as causing a deterioration in oxidative stability, can effect an improvement in oxidative stability. The invention has been based on these novel findings by which it has been found possible to obtain a diesel oil composition with excellent oxidative stability at temperatures as high as 140° C. whilst having a reduced sulfur content of not more than 10 ppm by mass.

In the diesel oil composition of the invention, if necessary, one or more diesel oil blending components are treated in a two-stage apparatus such as a desulfurisation apparatus so that the finally obtained diesel oil composition has the low sulfur characteristics specified as aforementioned, and, while the sulfur content is kept to not more than 10 ppm by mass, it is still possible to utilise a mixture of one or two or more diesel oil blending components irrespective of their sulfur content.

For the diesel oil blending components it is possible to use one or more kerosine fractions or diesel oil fractions obtained by atmospheric distillation of crude oil, and desulfurised kerosine or desulfurised diesel oil where these have been desulfurised. Directly desulfurised diesel oils obtained from direct desulfurisation apparatus, or indirectly desulfurised diesel oils obtained from indirect desulfurisation apparatus, or light cycle oils obtained from fluid catalytic cracking apparatus can also be used. Furthermore, it is even possible to use blending components such as oils equivalent to diesel oils distilled from petroleum refining two-stage apparatus, being hydrocracked diesel oils, or Fischer-Tropsch-derived synthetic oils.

For the method of adjustment, it is possible, for example, to mix a light cycle oil with a diesel oil fraction obtained from an atmospheric distillation apparatus and to perform desulfurisation treatment down to a sulfur content of not more than 10 ppm by mass. It is also possible to carry out a further hydrogenation treatment in order to improve the colour of the diesel oil composition obtained. The various desulfurisation conditions such as the type or proportions of raw materials in the desulfurisation apparatus can also be adjusted so that the contents of acenaphthylenes and fluorenes destroyed or formed by the reaction within the desulfurisation apparatus are within the appropriate ranges in the final product. In this case, it is not desirable to give too much consideration to the colour, this having no effect on the requisite characteristics as a fuel. The most suitable condition is that the Saybolt colour is not more than +25, though preferable conditions are that it is not more than +10 or not more than −16.

Various kinds of additives can be appropriately blended with the diesel oil composition appertaining to this invention as required. For example, it is possible to add one type or, in combination, two or more types of additives such as low-temperature pour point improvers, cetane number improvers, surface active agents, rust inhibitors, defoaming agents, detergents, colour improvers or lubricity improvers. The diesel oil composition of this invention in itself has excellent oxidative stability, but this does not mean there is any restriction on adding anti-oxidants.

Thus a diesel oil composition of the present invention may comprise one or more diesel base fuel components, as noted above. It will preferably comprise a liquid hydrocarbon middle distillate fuel, for example a gas oil. It may be or contain a kerosene fuel component. It may be petroleum derived. Alternatively, as noted above, it may be synthetic: for instance it may be the product of a Fischer-Tropsch condensation. It may be or include a biofuel component, which has been derived—whether directly or indirectly—from a biological source. It may be or include an oxygenate, for example a fatty acid alkyl ester, for example rapeseed methyl ester or soya methyl ester. The concentration of the one or more additional diesel fuel components, in a formulation according to the invention, may be 70% v/v or greater. It may for example be 75 or 80 or 85% v/v or greater, or in cases 90 or 92 or 95% v/v or greater. The concentration of the one or more additional diesel fuel components may be up to 99% v/v, or up to 98% v/v, or up to 95 or 92 or 90% v/v, or in cases up to 85 or 80% v/v. The additional diesel fuel component(s) (for example diesel base fuel(s)) may represent the major proportion of a fuel formulation according to the invention. A fuel formulation according to the invention may also contain one or more standard fuel or refinery additives, in particular additives which are suitable for use in automotive diesel fuels, as noted above. Such additives may be added at any point during the preparation of the formulation, including as a premix with one or more other components of the formulation. They may be included at a concentration of up to 300 ppmw, for example in the range of from 50 to 300 ppmw, based on the overall formulation.

The present invention will now be illustrated by the following Examples; the invention is, of course, not limited to the examples of embodiments shown below.

Example of Embodiment 1

A low-sulfur diesel oil composition obtained by desulfurisation treatment, using a commercial desulfurisation catalyst, of an oil which was a mixture of 92 vol % of a straight distillation diesel oil fraction of boiling point range 181 to 362° C. and 8 vol % of a light cycle oil of boiling point range 145 to 374° C. distilled from a fluid catalytic cracking apparatus down to a sulfur content of not more than 10 ppm by mass under conditions of liquid hourly space velocity 1.1, hydrogen partial pressure 5 MPa and hydrogen-oil ratio 250 NL/L.

Example of Embodiment 2

A low-sulfur diesel oil composition with the fluorenes concentration adjusted by adding a fluorene reagent equivalent to 10000 ppm by mass to Example of Embodiment 1.

Example of Embodiment 3

A low-sulfur diesel oil composition obtained by desulfurisation treatment, using the same catalyst as in Example of Embodiment 1, of a straight distillation fraction of boiling point range 181 to 350° C. down to a sulfur content of not more than 10 ppm by mass under conditions of liquid hourly space velocity 1.1, hydrogen partial pressure 6 MPa and hydrogen-oil ratio 270 NL/L.

Example of Embodiment 4

A low-sulfur diesel oil composition with the acenaphthylenes concentration adjusted by adding an acenaphthylene reagent equivalent to 1800 ppm by mass to Example of Embodiment 3.

Example of Embodiment 5

A low-sulfur diesel oil composition with the fluorenes concentration adjusted by adding a fluorene reagent equivalent to 180 ppm by mass to Example of Embodiment 3.

In order to confirm the effects of the aforementioned examples of embodiment, the following comparative examples were also prepared.

Comparative Example 1

A low-sulfur diesel oil composition with the acenaphthylenes concentration adjusted by adding an acenaphthylene reagent equivalent to 5000 ppm by mass to Example of Embodiment 3.

Comparative Example 2

A low-sulfur diesel oil composition with the acenaphthylenes concentration adjusted by adding an acenaphthylene reagent equivalent to 2500 ppm by mass to Example of Embodiment 3.

Comparative Example 3

A diesel oil composition obtained by desulfurisation treatment, using the same catalyst as in Example of Embodiment 1, of an oil which was a mixture of 80 vol % of a straight distillation diesel oil fraction of boiling point range 178 to 365° C. and 20 vol % of a light cycle oil of boiling point range 150 to 380° C. distilled from a fluid catalytic cracking apparatus down to a sulfur content of not more than 10 ppm by mass under conditions of liquid hourly space velocity 2.0, hydrogen partial pressure 4 MPa and hydrogen-oil ratio 200 NL/L.

Comparative Example 4

A low-sulfur diesel oil composition with the acenaphthylenes concentration adjusted by adding an acenaphthylene reagent equivalent to 2000 ppm by mass to Example of Embodiment 3.

Comparative Example 5

A commercial diesel oil.

The characteristics of Examples of Embodiment 1 to 5 and Comparative Examples 1 to 5 are shown in Table 1.

TABLE 1

| | Ex. of Emb. 1 | Ex. of Emb. 2 | Ex. of Emb. 3 | Ex. of Emb. 4 | Ex. of Emb. 5 | Comp. Ex. 1 | Comp. Ex. 2 | Comp. Ex. 3 | Comp. Ex. 4 | Comp. Ex. 5 |
|---|---|---|---|---|---|---|---|---|---|---|
| Density [g/cm$^3$] | 0.8405 | 0.8426 | 0.8189 | 0.8193 | 0.8190 | 0.8201 | 0.8195 | 0.8417 | 0.8194 | 0.8185 |
| Sulfur [ppm by mass] | 7 | 7 | 8 | 8 | 8 | 8 | 8 | 6 | 8 | 6 |
| Total aromatics vol % | 21.0 | 22.1 | 15.1 | 15.3 | 15.0 | 15.8 | 15.4 | 21.6 | 15.4 | 18.3 |
| Monocyclic aromatics vol % | 19.7 | 20.0 | 14.5 | 14.4 | 14.4 | 14.5 | 14.5 | 19.8 | 14.5 | 17.5 |
| Bicyclic aromatics vol % | 1.3 | 1.4 | 0.6 | 0.7 | 0.6 | 1.0 | 0.8 | 1.4 | 0.7 | 0.8 |
| Tricyclic or higher aromatics vol % | 0.0 | 0.7 | 0.0 | 0.2 | 0.0 | 0.3 | 0.1 | 0.4 | 0.2 | 0.0 |
| Saybolt colour | −16 or less | −16 or less | +21 | −16 or less | +19 | −16 or less | −16 or less | −16 or less | −16 or less | +27 |
| ASTM colour | L1.0 | L1.0 | L0.5 | L1.5 | L0.5 | L2.0 | L1.5 | L1.5 | L1.5 | L0.5 |
| T90 | 334.5 | 335.5 | 300.0 | 301.0 | 299.0 | 299.5 | 298.5 | 334.0 | 300.0 | 321.0 |
| Acenaphthylenes [ppm by mass] | 430 | 426 | 29 | 1829 | 28 | 5029 | 2529 | 5445 | 2029 | 13 |
| Fluorenes [ppm by mass] | 1800 | 11800 | 210 | 208 | 390 | 207 | 208 | 1920 | 208 | 40 |
| Induction period [minutes] | 77.69 | 123.6 | 75.26 | 66.17 | 87.98 | 48.97 | 59.28 | 63.48 | 63.3 | 63.8 |

The characteristics shown in Table 1 were measured by the following methods.

Density (@ 15° C.):

Density at 15° C. determined in accordance with JIS K 2249 "Crude petroleum and petroleum products—Determination of density and density/mass/volume conversion tables".

Sulfur content:

Sulfur content obtained in accordance with JIS K 2541-2 "Crude oil and petroleum products—Determination of sulfur content. Part 2: Oxidative microcoulometry"

Aromatics:

The aromatic hydrocarbon components with one ring, two rings and three or more rings, and the sum of these, were determined in accordance with JPI-5S-49-97 "Petroleum products—Determination of hydrocarbon types—High-pressure liquid chromatography".

Saybolt colour, ASTM colour:

Determined in accordance with JIS K 2580 "Crude petroleum and petroleum products—determination of colour".

T90:

90% distillation temperature in distillation characteristics determined in accordance with JIS K 2254 "Crude petroleum and petroleum products—Determination of distillation characteristics".

Acenaphthylenes, fluorenes:

The samples were fractionated according to saturation and the aromatic component by means of silica gel chromatography, then the aromatic component was measured under the following conditions by means of a HP-7890 HP 6976 four-pole mass spectrometer, so that the proportions of fluorenes and acenaphthylenes within the aromatic component were obtained.

Column: Shimazu Rtx-50: 30 m×0.25 mm×0.25 μm

Oven temperature: 30° C. (5 min)→8° C./min→300° C. (11 min)

Injection temperature: 300° C. split mode

Interface temperature: 300° C.

Carrier gas: He: 1.2 ml/min Constant flow mode ON

Solvent delay: 5.0 min

SIM parameters

TABLE 2

| Target component | Specified range | Ions using SIM determination |
|---|---|---|
| Fluorenes | 26.95~27.80 | 180 |
| | 27.80~29.45 | 194 |
| Acenapthylenes | 29.45~31.15 | 152 |
| | 29.45~31.15 | 208 |

Ionising voltage: 70 eV

Injection method: Split injection 1.0 μl

Amounts of fluorenes and acenaphthylenes in the diesel oil composition:

The amounts of fluorenes and acenaphthylenes in the diesel oil composition were obtained by multiplying the compositional proportions according to type in the aromatic component by the proportions of the aromatic component within the diesel oil composition.

Induction period (by the PetroOXY method):

As an indicator of oxidative stability, an initial oxygen pressure of 700 kPa was set using a PetroOXY oxidation stability test apparatus (manufactured by Petrotest Co) and the period elapsing until the pressure reduced 10% from the maximum was measured. In this test, the test temperature was made 140° C. in order to evaluate oxidative stability at a high temperature. The oxidative stability of a commercial diesel oil (Comparative Example 5) was used for reference, and a pass was taken to be not less than 65 minutes.

As shown in Table 1, it was confirmed that acenaphthylenes cause deterioration of oxidative stability, and also fluorenes effect an improvement in oxidative stability. As for the relationship of acenaphthylenes and fluorenes which have directly opposite effects on oxidative stability, it was confirmed that even in the case where the amount of fluorenes is 200 ppm by mass, which is relatively small, if the acenaphthylenes are not more than 2000 ppm by mass, sufficient oxidative stability is achieved (induction period not less than 65 minutes).

Also, as for T90, which is a characteristic exerting an influence on performance of diesel engines for use in cars, it was rather high in Examples of Embodiment 1 and 2 where the Saybolt colour was low, which means that it is evident that a reduction in Saybolt colour is not something that has an effect on performance of diesel engines for use in cars. The Saybolt colour of diesel oils used in diesel engines for cars is generally preferred to be not less than +25, and almost all diesel oils on the market have a Saybolt colour of not less than +25. Depending on circumstances, it may even be +30 or higher. However, the colour itself, as mentioned above, is not something that has any effect on performance of diesel engines for use in cars, and so it was confirmed that even if the Saybolt colour is reduced, if it is possible to improve oxidative stability, which does have a major effect on the performance of diesel engines for use in cars, it can be said that this is preferable for fuels of diesel engines for use in cars.

What is claimed is:

1. A diesel oil composition having sulfur content of at most 10 ppm by mass, the fluorenes content of at least 200 ppm by mass and the acenaphthylenes content of at most 2000 ppm by mass.

2. The diesel oil composition of claim 1 wherein said fluorenes content is at most 12000 ppm by mass.

3. The diesel oil composition of claim 1 wherein said acenaphthylenes content is at least 25 ppm by mass.

4. The diesel oil composition of claim 2 wherein said acenaphthylenes content is at least 25 ppm by mass.

5. The diesel oil composition of claim 3 wherein the Saybolt colour is not more than +25.

6. The diesel oil composition of claim 1 wherein the induction period from a pressure of an initial oxygen pressure of 700 kPa until the pressure is reduced 10% is not less than 65 minutes.

7. The diesel oil composition of claim 3 wherein the induction period from an initial oxygen pressure of 700 kPa until the pressure is reduced 10% is not less than 65 minutes.

8. The diesel oil composition of claim 4 wherein the induction period from an initial oxygen pressure of 700 kPa until the pressure is reduced 10% is not less than 65 minutes.

9. A method of operating an internal combustion engine, and/or a vehicle which is driven by an internal combustion engine, which method involves introducing into a combustion chamber of the engine a diesel fuel formulation of claim 1.

10. The diesel oil composition of claim 6 wherein the temperature during the induction period is 140 degrees C.

11. The diesel oil composition of claim 7 wherein the temperature during the induction period is 140 degrees C.

12. The diesel oil composition of claim 8 wherein the temperature during the induction period is 140 degrees C.

13. The diesel oil composition of claim 1 wherein the sulfur content is in a range of 3 to 10 ppm by mass.

14. The diesel oil composition of claim 1 wherein the fluorenes content is not less than 500 ppm by mass.

15. The diesel oil composition of claim 1 wherein the fluorenes content is at least 1500 ppm by mass.

16. The diesel oil composition of claim 1 wherein the fluorenes content is at most 5000 ppm by mass.

17. The diesel oil composition of claim 1 wherein the fluorenes content is at most 2000 ppm by mass.

18. The diesel oil composition of claim 1 wherein said acenaphthylenes content is at least 400 ppm by mass.

19. The diesel oil composition of claim 3 wherein the Saybolt colour is not more than +10.

20. The diesel oil composition of claim 3 wherein the Saybolt colour is not more than −16.

* * * * *